US005672245A

United States Patent [19]

Andtbacka et al.

[11] Patent Number: 5,672,245

[45] Date of Patent: Sep. 30, 1997

[54] RECYCLING OF KNOTS IN A CONTINUOUS PROCESS FOR COOKING CHEMICAL PULP

[75] Inventors: Elisabeth Andtbacka; Stig Andtbacka; Anders Bergqvist, all of Karlstad, Sweden

[73] Assignee: Kvaerner Pulping Technologies Aktiebolag, Sweden

[21] Appl. No.: 530,350

[22] PCT Filed: Nov. 28, 1994

[86] PCT No.: PCT/SE94/01135

§ 371 Date: Nov. 6, 1995

§ 102(e) Date: Nov. 6, 1995

[87] PCT Pub. No.: WO95/23257

PCT Pub. Date: Aug. 31, 1995

[30] Foreign Application Priority Data

Feb. 23, 1994 [SE] Sweden ..... 9400616

[51] Int. Cl.[6] ..... D21C 3/24; D21C 9/00

[52] U.S. Cl. ..... 162/17; 162/55; 162/243

[58] Field of Search ..... 162/17, 19, 55, 162/60, 243

[56] References Cited

U.S. PATENT DOCUMENTS

| | | | |
|---|---|---|---|
| 3,393,121 | 7/1968 | Lea et al. | 162/25 |
| 3,886,035 | 5/1975 | Laakso | 162/55 |
| 4,002,528 | 1/1977 | Laakso | 162/237 |
| 5,302,247 | 4/1994 | Richardsen et al. | 162/42 |
| 5,401,361 | 3/1995 | Prough et al. | 162/17 |

FOREIGN PATENT DOCUMENTS

| | | |
|---|---|---|
| 2650735 | 7/1984 | Germany . |

*Primary Examiner*—Donald E. Czaja
*Assistant Examiner*—Dean T. Nguyen
*Attorney, Agent, or Firm*—Ronald P. Kananen

[57] ABSTRACT

The present invention relates to a process for continuous cooking of chemical pulp, in which the chips are fed into a chip chute (3), which is arranged on top of a high pressure feeder (4) for passing the chips into a downstream, pressurized continuous digester housing comprising a vertical, elongate digester (5) into which the chips are fed at the top and from which the cooked pulp is fed out at the bottom, in order thereafter to be defibred and washed, after which the defibred pulp is screened, and an accepted flow of pulp is obtained which is fed onwards for continued treatment, and a reject flow is obtained which consists principally of knots, which reject flow is thus separatedoff from the pulp flow, the reject flow, which consists principally of knots, being returned to the chip chute (3), preferably after concentration and washing.

22 Claims, 2 Drawing Sheets

RECYCLING OF KNOTS IN A CONTINUOUS PROCESS FOR COOKING CHEMICAL PULP

TECHNICAL FIELD

The present invention relates to a process for continuous cooking of chemical pulp, and relates in particular to a process for dealing with knots in conjunction with the continuous cooking of chemical pulp.

PRIOR ART AND PROBLEMS

When cooking pulp, the majority of the raw wood which is cooked will have been delignified to a sufficient extent for defibration to be achieved. However, a relatively small proportion of the raw wood consists of knots which differ in character from the rest of the raw wood insofar as they are more difficult to cook, i.e., they require a longer dwell time in order for sufficient delignification to be achieved. This problem is usually solved by separating these knots off, after cooking, and returning them to the digester for repeated treatment. In this respect, the knots are normally separated off by screening and are then conveyed to a washing stage and, directly thereafter, to a knot bin. The knots are then fed/blown from the knot bin into the chip bin and thereby commence their second cooking run. The disadvantage of such a process is that a relatively large amount of energy is required to transport the knots right up to the top of the relatively high chip bin. Moreover, fairly expensive equipment, such as a sluice feeder, etc., is needed for transporting the knots. In addition, it is of course a disadvantage that the chip bin has to be constructed in such a way as to take into account the extra load which is exerted by the equipment for transporting and, if appropriate, for dewatering.

SOLUTION AND ADVANTAGES

According to the present invention the knots are conveyed from the knot dewatering device to a tank, from which they are transported to the chute circulation without first being fed down through the chip bin or the steaming vessel. The knots are preferably fed to the chip chute in the form of a relatively low consistency suspension, for example approximately 5%, with the aid of a centrifugal pump. By proceeding according to the invention, most of the abovementioned disadvantages are eliminated or at least minimized.

According to a further aspect of the invention, use is made of a black liquor and/or filtrate from one of the subsequent pulp washing stages, preferably following the screening, in order to dilute the knots/suspension to the desired strength.

BRIEF DESCRIPTION OF THE FIGURES

The invention will be described in greater detail hereinbelow with reference to the attached figures, in which:

FIG. 1 thus shows the "front part" of a fibre line. Chips are fed into a chip bin, preferably a HULA BINX™ (trademark of Kvaerner Pulping Technologies AB). From the chip bin 1 the chips are fed via a low pressure feeder into a steaming vessel 2, and from the end of the steaming vessel the chips are fed down into a chip chute 3. The pressure in the steaming vessel is approximately 1.5 bar. The chip chute 3 is mounted on top of a high pressure feeder 4, the purpose of which is to pass the chips into the digester 5 which is at a considerably higher pressure (at least 8 bar). The chips are thus fed with the aid of the high pressure feeder 4 to the top of the digester 5, where some of the transport liquor is separated off and re-circulated to the high pressure feeder. By means of holding a suitable temperature/temperatures and adding suitable chemicals, as is generally known to the person skilled in the art, the chips are cooked in the desired manner in the digester 5, by means of which a desired delignification is achieved. The ITCX™ method developed by Kamyr is preferably used, in which essentially the same temperature level is maintained in all the cooking zones so that the pulp can be cooked to very low kappa numbers, while retaining good strength properties. The cooked pulp, which has now been defibred, is now conveyed via the blow line 6 to a diffuser, which is arranged at the top of a storage tower 7. From the storage tower the pulp is conveyed to a screen 8 where reject material, partially in the form of knots, is separated off and is fed via a separate line 10 to a washing/concentrating device 11 for knots. Downstream of the concentrating device 11 the knots have a dry matter content of approximately 25–35%. The knots are conveyed onwards to a knot bin/tank 12, in which the knots, in a preferred embodiment of the invention, are mixed with black liquor which is brought, for example, from a flash cyclone, suitably cooled to below 100° C. and supplied via a separate line 13. The suspension in the knot tank 12 should have a dry matter content of approximately 5% so that it can be pumped with the aid of a centrifugal pump 12A. The suspension can conceivably be diluted to as low as 2%, and in another extreme case it can have a maximum dry matter content of approximately 7%.

From the knot tank 12 the knot suspension is thus pumped, preferably with the aid of a centrifugal pump 12A (for example a vortex pump), via line 14 to the chip chute 3. FIG. 1 shows that the chip chute 3 has been arranged with a separate connection piece 15 for attachment of line 14. A chute circulation 16 (shown diagrammatically) is arranged in a conventional manner, thus preferably comprising a circulation pump, sand trap and knot screen from which the reject material is re-circulated to the chip chute 3, expediently by a connection piece 15 arranged for this purpose.

Alternatively, instead of black liquor, it is possible to use a filtrate, preferably from one of the washing stages downstream of the knot screen, or combinations thereof. The liquid content in the return of the knot screen suspension can also be used for the purpose of regulating the liquid ratio to the chip chute and/or a particular chemical content. Furthermore, instead of leading the line 14 to its own connection piece, it is possible to lead the line into the circulation 16 so that the knot screen suspension is supplied to the chip chute via this connection piece.

Figure 1:
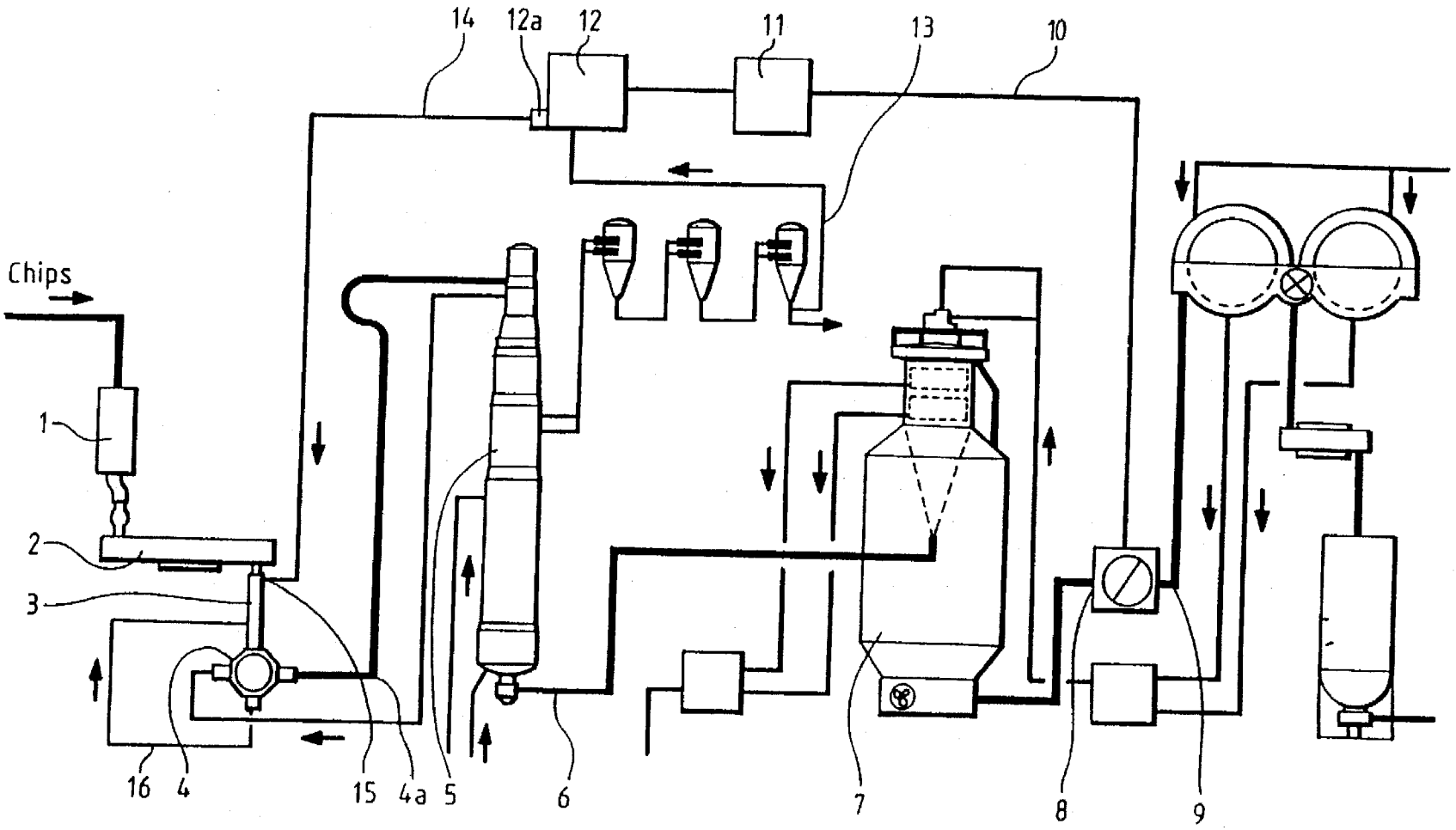
FIG. 1 shows a preferred embodiment of the invention in conjunction with a one-vessel digester.
Figure 2:
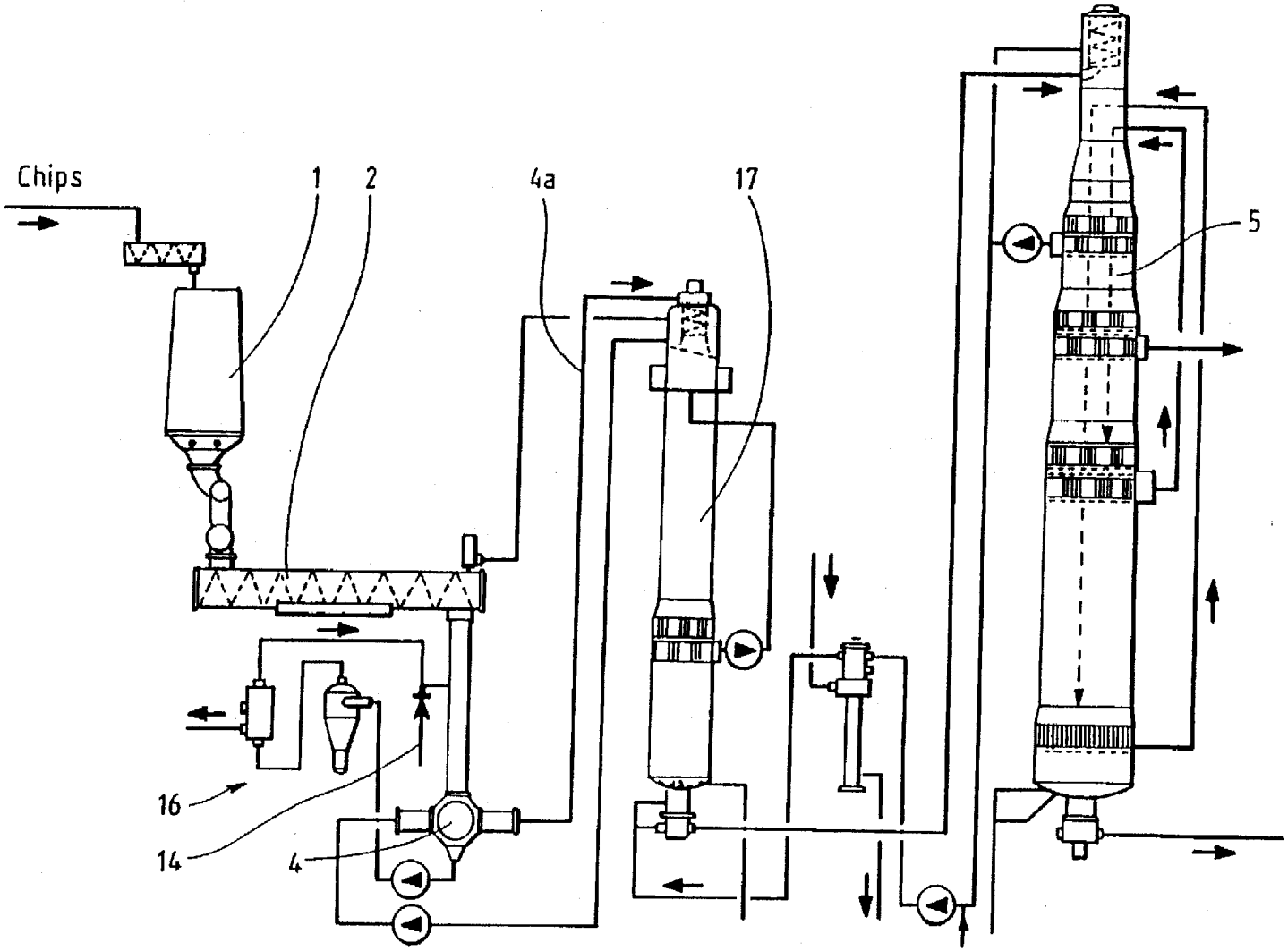
FIG. 2 shows an alternative embodiment of the invention in conjunction with a two-vessel system, i.e., with a separate impregnation vessel.

FIG. 2 shows an alternative embodiment of the invention, in which the invention is used in conjunction with a two-vessel system, i.e., when in addition to the digester 5 there is a separate vessel 17 for impregnation of the chips. The chute circulation 16 is shown in this figure with greater clarity, and the person skilled in the art can thus gather from the drawing that it includes, first, a pump thereafter a sand trap (cyclone) followed by a knot screen, from which the reject material is thus returned to the chip chute 3. The line 14, which is shown only in part, indicates where the knot suspension from the knot tank is expediently supplied, namely to the chute circulation, immediately in front of the connection to the chip chute 3. The separating-off of the knots and the manner in which these are returned also correspond in this case to that which has been described hereinabove in conjunction with FIG. 1, and are not therefore shown in greater detail. According to a preferred two-vessel embodiment, black liquor is used in the impregnation vessel. In this respect there are a number of procedures which can be used to utilize the black liquor in the best way, such as, for example, the method for which the applicants applied for a patent (Swedish Patent No. 8804578), and in which black liquor is used in an upper, co-current zone which at the bottom is displaced by black liquor and white liquor which are added to the bottom of the impregnation vessel (and are thus conveyed in counter-current to the chips), or the method for which the applicant applied for a patent two years later U.S. application Ser. No. 585,790 (1990 now abandoned) and in which essentially only black liquor is added at the bottom of the impregnation vessel, this black liquor being hot. Other methods are of course also conceivable, such as, for example, a purely co-current process.

The invention is not limited by what has been shown hereinabove, but instead can be varied within the scope of the patent claims which follow. Thus, the person skilled in the art will realize that it is possible, for example, to use a low pressure feeder for the purpose of passing the knot suspension into the chip chute.

We claim:

1. A process for the continuous cooking of chemical pulp, comprising the steps of:

feeding wood chips into a chip chute positioned on top of a high pressure feeder;

passing the chips from said high pressure feeder into a downstream, pressurized continuous digester housing, wherein said digester housing comprises a vertical, elongate digester having a top and a bottom, into the top of which digester said chips are fed and from the bottom of which digester cooked pulp is fed out;

defibrating and washing said cooked pulp;

screening said defibrated and washed pulp, such that an accepted flow of pulp and a rejected flow of pulp are obtained, wherein said rejected flow comprises principally of knots;

feeding said accepted flow onwards for continued treatment; and returning said rejected flow to said chip chute without passing through a chip bin or a steaming vessel.

2. The process according to claim 1, wherein said rejected flow, during its return to the chip chute, is concentrated and washed.

3. The process according to claim 1, wherein said rejected flow, during its return to the chip chute, comprises a suspension having a dry matter content of between 2% and 7%.

4. The process according to claim 3, wherein a centrifugal pump is used to return said rejected flow to the chip chute.

5. The process according to claim 3, wherein the dry matter content of said suspension is controlled by mixing the rejected flow with a liquid flow originating from another part of the pulp mill.

6. The process according to claim 5, wherein said liquid flow comprises principally black liquor.

7. The process according to claim 5, wherein said liquid flow comprises principally filtrate from a washing stage downstream of the digester housing.

8. The process according to claim 5, wherein said liquid flow is combined with the rejected flow in a separate tank.

9. The process according to claim 1, wherein said rejected flow, during its return to the chip chute, comprises a suspension having a dry matter content of between 4% and 6%.

10. The process according to claim 1, wherein said rejected flow, during its return to the chip chute, comprises a suspension having a dry matter content of approximately 5%.

11. The process according to claim 1, wherein the rejected flow is returned to the chip chute by means of a recirculation loop.

12. A device for the continuous cooking of chemical pulp, comprising:

a high pressure feeder;

a chip chute positioned on top of said high pressure feeder, for feeding wood chips into said high pressure feeder;

a pressurized continuous digester housing, downstream of said high pressure feeder, said digester housing comprising a vertical, elongate digester having a top and a bottom, into the top of which digester said chips are fed and from the bottom of which digester cooked pulp is fed out;

a defibrating and washing apparatus for treating said cooked pulp;

a screening apparatus for said defibrated and washed pulp, which results in an accepted flow of pulp and a rejected flow of pulp, wherein said rejected flow comprises principally of knots;

means for feeding said accepted flow onwards for continued treatment; and means for returning said rejected flow to said chip chute without passing through a chip bin or a steaming vessel.

13. The device according to claim 12, further comprising means for concentrating and washing said rejected flow during its return to the chip chute.

14. The device according to claim 12, further comprising means for diluting said rejected flow, during its return to the chip chute, to a suspension having a dry matter content of between 2% and 7%.

15. The device according to claim 14, wherein said means for returning said rejected flow to the chip chute comprises a centrifugal pump.

16. The device according to claim 14, further comprising means for mixing the rejected flow with a liquid flow originating from another part of the pulp mill to achieve the dry matter content of said suspension.

17. The device according to claim 16, wherein said liquid flow comprises principally black liquor.

18. The device according to claim 16, wherein said liquid flow comprises principally filtrate from a washing stage downstream of the digester housing.

19. The device according to claim 16, wherein said mixing means comprises a separate tank for combining the liquid flow with the rejected flow.

20. The device according to claim 12, further comprising means for diluting said rejected flow, during its return to the chip chute, to a suspension having a dry matter content of between 4% and 6%.

21. The device according to claim 12, further comprising means for diluting said rejected flow, during its return to the chip chute, to a suspension having a dry matter content of approximately 5%.

22. The device according to claim 12, further comprising a recirculation loop for returning the rejected flow to the chip chute.

* * * * *